US007652570B2

(12) United States Patent
Fujimoto et al.

(10) Patent No.: US 7,652,570 B2
(45) Date of Patent: Jan. 26, 2010

(54) INFORMATION PROCESSING DEVICE, ORGANIZATIONAL ANALYSIS SYSTEM, COMPUTER READABLE MEDIUM AND METHOD

(75) Inventors: Masakazu Fujimoto, Kanagawa (JP); Yuichi Ueno, Kanagawa (JP); Atsushi Ito, Kanagawa (JP); Keiichi Nemoto, Kanagawa (JP); Manabu Ueda, Kanagawa (JP); Nobuhiro Yamasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 308 days.

(21) Appl. No.: 11/808,348

(22) Filed: Jun. 8, 2007

(65) Prior Publication Data

US 2008/0129489 A1 Jun. 5, 2008

(30) Foreign Application Priority Data

Nov. 30, 2006 (JP) ..... 2006-325064

(51) Int. Cl.
*G08B 1/08* (2006.01)
*G08B 13/14* (2006.01)

(52) U.S. Cl. ..... 340/539.11; 340/572.1

(58) Field of Classification Search ... 340/572.1–572.9, 340/539.1–539.21, 825.77, 657, 658
See application file for complete search history.

(56) References Cited

U.S. PATENT DOCUMENTS

| | | | | |
|---|---|---|---|---|
| 5,745,037 | A * | 4/1998 | Guthrie et al. | 340/573.4 |
| 6,104,290 | A * | 8/2000 | Naguleswaran | 340/572.1 |
| 7,095,319 | B2 * | 8/2006 | Izumi et al. | 340/539.11 |
| 2005/0196131 | A1 | 9/2005 | Narusawa et al. | |
| 2007/0008118 | A1 * | 1/2007 | Kassiedass | 340/539.21 |

FOREIGN PATENT DOCUMENTS

| | | |
|---|---|---|
| JP | A 2000-341752 | 12/2000 |
| JP | A-2002-150456 | 5/2002 |
| JP | A 2003-36492 | 2/2003 |
| JP | A-2004-007496 | 1/2004 |
| JP | A-2005-024540 | 1/2005 |
| JP | A-2005-175660 | 6/2005 |
| JP | A-2005-252868 | 9/2005 |
| JP | A-2006-311111 | 11/2006 |

* cited by examiner

*Primary Examiner*—Jennifer Mehmood
(74) *Attorney, Agent, or Firm*—Oliff & Berridge, PLC

(57) ABSTRACT

An information processing device includes: a detecting unit that detects the electric field intensity of information received from a portable transmission device that transmits information through radio waves; and a determining unit that determines whether the transmission device is being carried, based on a change in the electric field intensity detected by the detecting unit.

19 Claims, 22 Drawing Sheets

FIG. 6

| RECEIVING TIME | AREA ID | TAG ID | SIGNAL STRENGTH |
|---|---|---|---|
| 17:36:00 | A | a | 162 |
| 17:36:00 | A | b | 196 |
| 17:36:00 | A | c | 207 |
| 17:36:00 | B | d | 138 |
| 17:36:00 | B | e | 167 |
| 17:36:00 | C | f | 181 |
| 17:36:05 | A | a | 161 |
| 17:36:05 | A | b | 196 |
| 17:36:05 | A | c | 208 |
| 17:36:05 | B | d | 122 |
| 17:36:05 | B | e | 167 |
| 17:36:05 | C | f | 195 |
| .. | .. | .. | .. |

FIG. 8

| RECEIVING TIME | AREA ID | TAG ID | SIGNAL STRENGTH |
|---|---|---|---|
| 17:36:00 | C | f | 200 |
| 17:36:05 | C | f | 202 |
| 17:36:10 | C | f | 203 |
| 17:36:15 | A | f | 180 |
| 17:36:20 | A | f | 182 |
| 17:36:25 | A | f | 179 |
| ⋮ | ⋮ | ⋮ | ⋮ |

FIG. 9

| RECEIVING TIME | TAG A | TAG B | TAG C |
|---|---|---|---|
| 17:36:00 | 162 | 196 | 207 |
| 17:36:05 | 161 | 196 | 208 |
| 17:36:10 | 161 | 195 | 207 |
| 17:36:15 | 160 | 195 | 208 |
| 17:36:20 | 161 | 196 | 208 |
| 17:36:25 | 164 | 187 | 208 |
| 17:36:30 | 165 | 184 | 207 |
| 17:36:35 | 165 | 188 | 208 |
| 17:36:40 | 164 | 189 | 208 |
| 17:36:45 | 164 | 190 | 208 |
| 17:36:50 | 164 | 192 | 207 |
| 17:36:55 | 165 | 192 | 208 |
| 17:37:00 | 161 | 190 | 207 |
| 17:37:05 | 160 | 191 | 207 |
| 17:37:10 | 159 | 205 | 208 |
| 17:37:15 | 160 | 203 | 208 |
| 17:37:20 | 158 | 206 | 207 |
| 17:37:25 | 157 | 206 | 208 |
| 17:37:30 | 157 | 189 | 207 |
| : | : | : | : |

FIG. 12

| RECEIVING TIME | AREA ID | TAG ID | SIGNAL STRENGTH | DETERMINATION RESULT |
|---|---|---|---|---|
| 17:36:00 | A | a | 162 | CARRIED |
| 17:36:00 | A | b | 196 | CARRIED |
| 17:36:00 | A | c | 207 | NOT CARRIED |
| 17:36:00 | B | d | 138 | CARRIED |
| 17:36:00 | B | e | 167 | NOT CARRIED |
| 17:36:00 | C | f | 181 | CARRIED |
| 17:36:05 | A | a | 161 | CARRIED |
| 17:36:05 | A | b | 196 | CARRIED |
| 17:36:05 | A | c | 208 | NOT CARRIED |
| 17:36:05 | B | d | 122 | CARRIED |
| 17:36:05 | B | e | 167 | NOT CARRIED |
| 17:36:05 | C | f | 195 | CARRIED |
| : | : | : | : | : |

FIG. 17

| DETERMINATION RESULT | TAG ID | CONTROL MODE |
|---|---|---|
| CARRIED | c | VIBRATOR |
| NOT CARRIED | c | RINGING TONE |
| CARRIED | a,b | ———— |
| NOT CARRIED | a,b | BUZZER TONE |
| : | : | : |

FIG. 20

| TIME | DETECTED (VARIED) | DETECTED (UNVARIED) | UNDETECTED | ATTENDANCE RATE | CORRECTED ATTENDANCE RATE |
|---|---|---|---|---|---|
| 6:00:00 | 0 | 15 | 374 | 3.9% | 0% |
| 7:00:00 | 0 | 15 | 374 | 3.9% | 0% |
| 8:00:00 | 22 | 15 | 352 | 9.5% | 5.9% |
| 9:00:00 | 274 | 12 | 103 | 73.5% | 72.7% |
| 10:00:00 | 303 | 9 | 77 | 80.2% | 79.7% |
| 11:00:00 | 225 | 10 | 154 | 60.4% | 59.4% |
| 12:00:00 | 136 | 10 | 243 | 37.5% | 35.9% |
| 13:00:00 | 168 | 11 | 210 | 46.0% | 44.4% |
| 14:00:00 | 173 | 11 | 205 | 47.3% | 45.8% |
| 15:00:00 | 171 | 11 | 207 | 46.8% | 45.2% |
| 16:00:00 | 206 | 11 | 172 | 55.8% | 54.5% |
| 17:00:00 | 324 | 8 | 57 | 85.3% | 85.0% |
| 18:00:00 | 261 | 10 | 118 | 69.7% | 68.9% |
| 19:00:00 | 213 | 13 | 163 | 58.1% | 56.6% |
| 20:00:00 | 115 | 13 | 261 | 32.9% | 30.6% |
| 21:00:00 | 64 | 14 | 311 | 20.1% | 17.1% |
| 22:00:00 | 38 | 15 | 336 | 13.6% | 10.2% |
| 23:00:00 | 2 | 16 | 372 | 4.4% | 0.5% |
| : | : | : | : | : | : |

FIG. 21

| TIME | DIVISION X | | | DIVISION Y | | | | DIVISION Z | |
|---|---|---|---|---|---|---|---|---|---|
| | TAG X1 | TAG X2 | TAG X3 | TAG Y1 | TAG Y2 | TAG Y3 | TAG Y4 | TAG Z1 | TAG Z2 |
| : | : | : | : | : | : | : | : | : | : |
| 11:05:00 | 186 | 173 | 0 | 0 | 0 | 0 | 214 | 0 | 193 |
| 11:10:00 | 163 | 185 | 0 | 0 | 0 | 0 | 214 | 0 | 198 |
| 11:15:00 | 171 | 152 | 0 | 0 | 0 | 0 | 214 | 0 | 187 |
| 11:20:00 | 166 | 169 | 0 | 0 | 0 | 0 | 214 | 0 | 175 |
| : | : | : | : | : | : | : | : | : | : |
| 16:55:00 | 0 | 0 | 0 | 0 | 0 | 0 | 195 | 166 | 0 |
| 17:00:00 | 0 | 0 | 0 | 0 | 0 | 0 | 172 | 148 | 0 |
| 17:05:00 | 0 | 0 | 0 | 0 | 0 | 0 | 183 | 159 | 0 |
| 17:10:00 | 0 | 0 | 0 | 0 | 0 | 0 | 191 | 172 | 0 |
| : | : | : | : | : | : | : | : | : | : |

FIG. 22A

| | DIVISION X | DIVISION Y | DIVISION Z |
|---|---|---|---|
| DIVISION X | | 1 | 1 |
| DIVISION Y | 1 | | 2.5 |
| DIVISION Z | 1 | 2.5 | |

FIG. 22B

| | DIVISION X | DIVISION Y | DIVISION Z |
|---|---|---|---|
| DIVISION X | | 0 | 1 |
| DIVISION Y | 0 | | 1.5 |
| DIVISION Z | 1 | 1.5 | |

INFORMATION PROCESSING DEVICE, ORGANIZATIONAL ANALYSIS SYSTEM, COMPUTER READABLE MEDIUM AND METHOD

CROSS-REFERENCE TO RELATED APPLICATIONS

This application is based on and claims priority under 35 USC 119 from Japanese Patent Application No. 2006-325064 filed Nov. 30, 2006.

BACKGROUND

1. Technical Field

The present invention relates to an information processing device that determines whether a transmission device transmitting radio waves is being carried, an organizational analysis system, a computer readable medium and a method.

2. Related Art

Conventionally, location detecting systems that utilize transmission devices transmitting radio waves have been used to detect the activities of people in an office and record activity logs.

However, in a location detecting system that operates on the assumption that each person always carries his/her transmission device, accurate activity logs cannot be collected, if a person leaves or loses the transmission device, or the power of the transmission device runs out.

SUMMARY

According to an aspect of the present invention, there is provided an information processing device including a detecting unit that detects an electric field intensity of information received from a portable transmission device that transmits information through radio waves, and a determining unit that determines whether the transmission device is being carried, based on a change in the electric field intensity detected by the detecting unit.

BRIEF DESCRIPTION OF THE DRAWINGS

Other objects, features and advantages of the present invention will become more apparent from the following detailed description when read in conjunction with the accompanying drawings, in which:

FIG. 6 shows an example of the history data stored in the history storing unit;

FIG. 8 shows a history of the tag f;

FIG. 9 shows the signal strength of each tag in the area A;

FIG. 12 shows an example of the history data to which the results of determinations of whether the transmission device is being carried are added;

FIG. 17 shows the table information that is to be used for determining the control mode for the remote terminal;

FIG. 20 is a list showing the attendance rates of company employees that are analyzed by the analyzing unit;

FIG. 21 is a list showing the signal strengths of the active RFID tags in each division in a conference area;

FIG. 22A is a list showing the communication amounts among the divisions in a conference area; and FIG. 22B is a list showing the communication amounts after corrections are made to the communication amounts shown in FIG. 22A.

DETAILED DESCRIPTION

The following is a description of exemplary embodiments of the present invention, with reference to the accompanying drawings.

First Exemplary Embodiment

Figure 1:
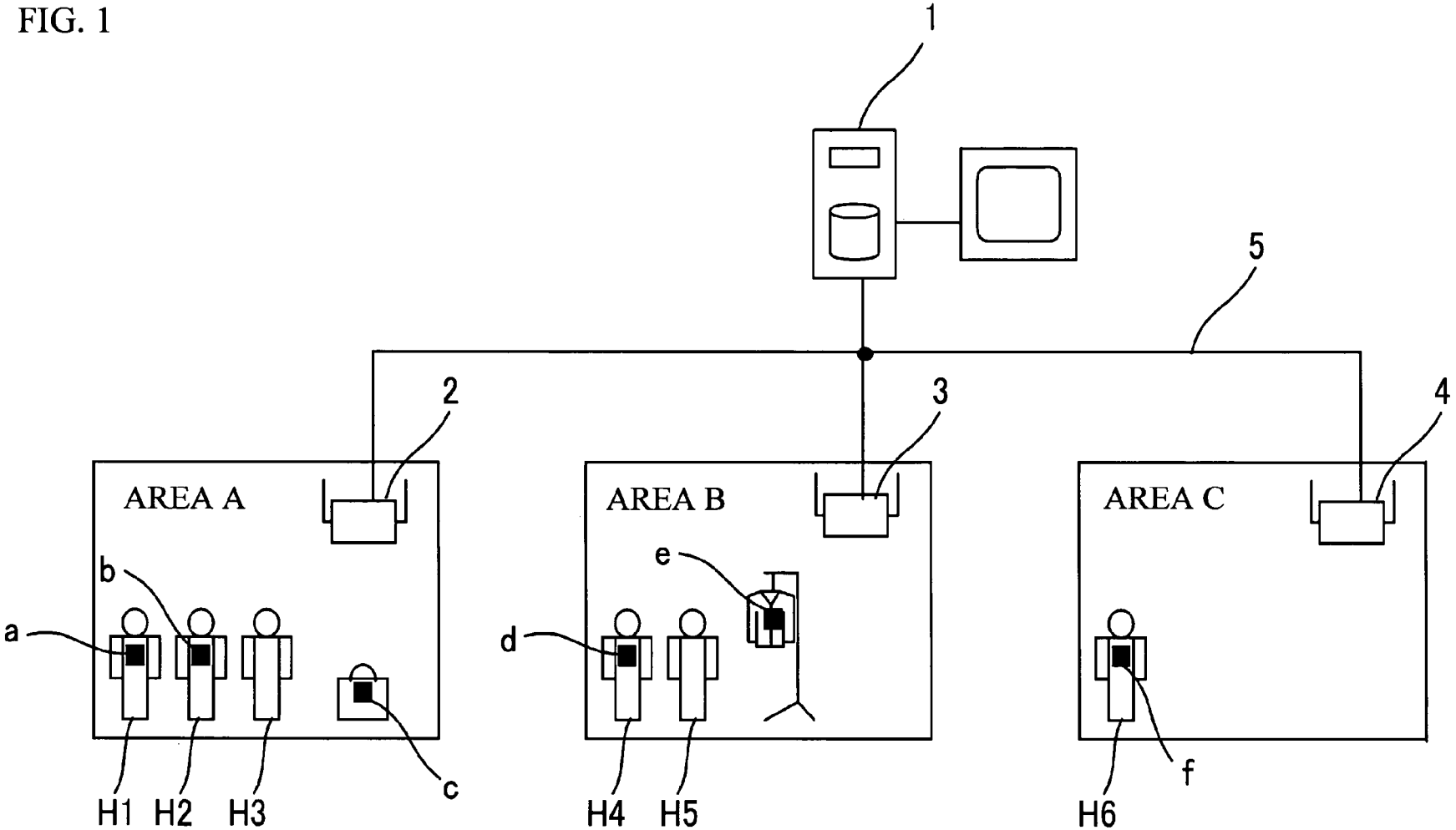
FIG. 1 illustrates the structure of an organizational analysis system that includes an information processing device in accordance with a first exemplary embodiment of the present invention.

FIG. 1 illustrates the structure of an organizational analysis system that includes an information processing device in accordance with a first exemplary embodiment of the present invention. The organizational analysis system shown in FIG. 1 includes an activity log collection server 1 as an information processing device, receivers 2 through 4 that are provided in areas A through C, respectively, and active RFID tags a through f. Each active RFID tag is equipped with a battery cell and spontaneously transmits a signal.

The active RFID tags a and b are carried by persons H1 and H2 in the area A. The active RFID tag c is placed in a handbag of a person H3 in the area A. The active RFID tag d is carried by a person H4 in the area B. The active RFID tag e is in a pocket of the jacket of a person H5 in the area B. The active RFID tag f is carried by a person H6 in the area C.

The receivers 2 through 4 are connected to the activity log collection server 1 via a communication line 5. The receiver 2 receives signals transmitted from the active RFID tags a through c. The receiver 3 receives signals transmitted from the active RFID tags d and e. The receiver 4 receives signals transmitted from the active RFID tag f. Each of the receivers sends the received signals to the activity log collection server 1 via the communication line 5. Based on the signals sent from the receivers, the activity log collection server 1 determines which receiver has detected which active RFID tag. By doing so, the activity log collection server 1 detects the location of each active RFID tag.

Figure 2:
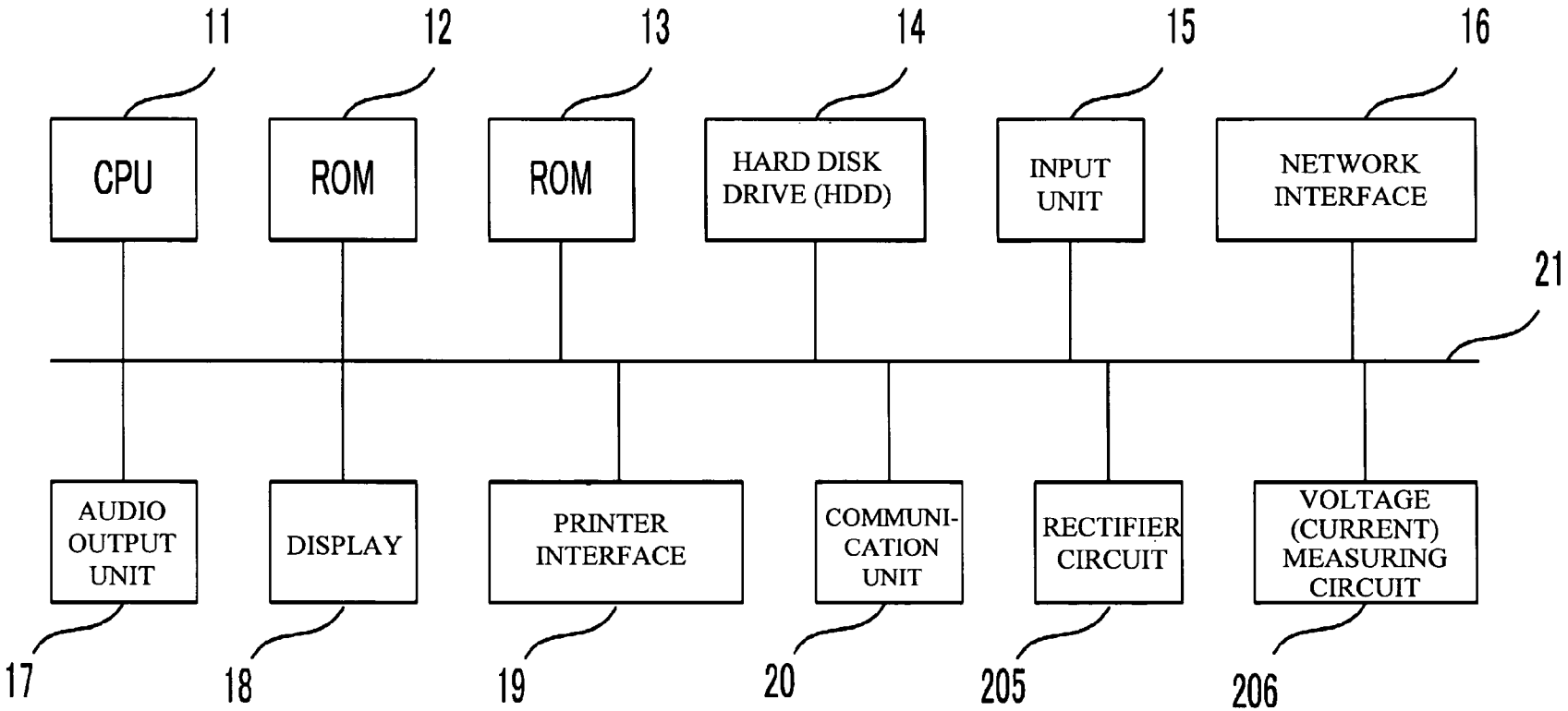
FIG. 2 illustrates the hardware structure of an activity log collection server as the information processing device of FIG. 1.

FIG. 2 illustrates the hardware structure of the activity log collection server as the information processing device shown in FIG. 1.

In FIG. 2, the activity log collection server 1 may be a computer, and includes a CPU 11 that controls the entire device, a ROM 12 that stores programs for controlling the device, a RAM 13 that temporarily stores information, a hard disk drive (HDD) 14 that stores programs for controlling the device, software programs, and various kinds of information, an input unit 15 formed components such as a mouse and a keyboard, a network interface 16 to be connected to an external device, an audio output unit 17 formed with a speaker or the like, a display 18 formed with a liquid crystal monitor or a CRT, a printer interface 19 to be connected to a printer, a communication unit 20 that communicates with external wireless devices, a rectifier circuit 205, and a voltage (current) measuring circuit 206.

The CPU 11 is connected to the ROM 12, the RAM 13, the HDD 14, the input unit 15, the network interface 16, the audio output unit 17, the display 18, the printer interface 19, the communication unit 20, the rectifier circuit 205, and the voltage (current) measuring circuit 206, via a system bus 21.

Figure 3:
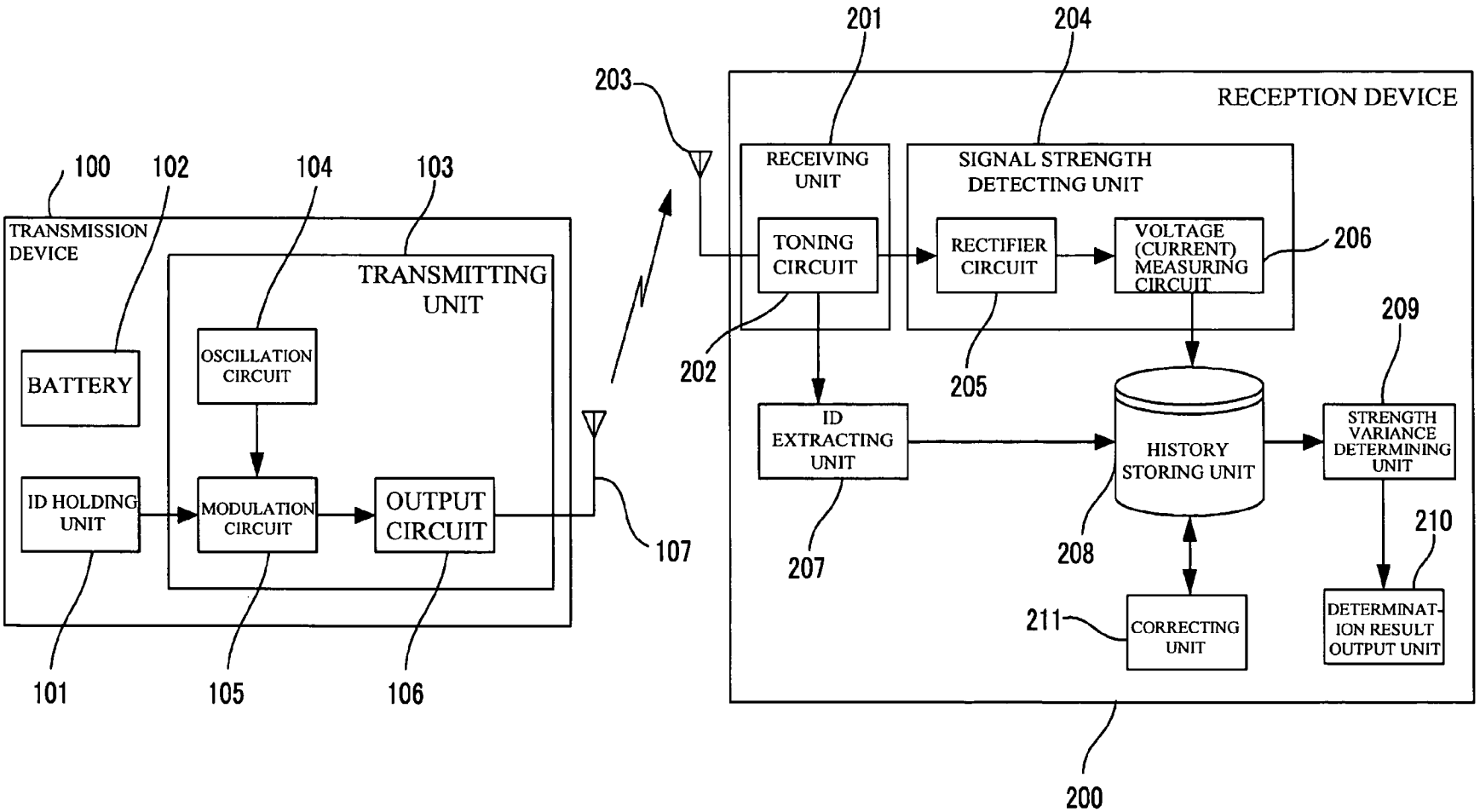
FIG. 3 is a functional block diagram of the activity log collection server, the receivers, and the active RFID tags of FIG. 1.

FIG. 3 is a functional block diagram of the activity log collection server, the receivers, and the active RFID tags shown in FIG. 1.

In FIG. 3, each of the active RFID tags shown in FIG. 1 is embodied by a transmission device 100, and the activity log collection server and each of the receivers are embodied by a reception device 200. In this exemplary embodiment, an active RFID tag is used as the transmission device. However, the present invention is not limited to that, and it is possible to employ a wireless device such as a portable telephone device or a PHS terminal.

The transmission device 100 includes an ID holding unit 101, a battery 102, and a transmitting unit 103. The ID holding unit 101 is a rewritable ROM, and holds a unique ID (hereinafter referred to as a tag ID) allotted to each transmission device. The battery 102 supplies power to the ID holding unit 101 and the transmitting unit 103. The transmitting unit 103 includes an oscillation circuit 104, a modulation circuit 105, an output circuit 106, and an antenna 107. The transmitting unit 103 transmits a signal containing the tag ID in predetermined timing. Here, the predetermined timing may be every two or three seconds, every minute, or every hour from 9:00 a.m. till 9:00 p.m.

The oscillation circuit 104 generates signals at a reference frequency in the frequency band in which transmission is to be performed. The oscillation circuit 104 may also generate signals at low frequencies and then multiply the signals, or generate signals at high frequencies and divide the signals. The modulation circuit 105 modulates signals with tag IDs or audio signals by the amplitude shift keying (ASK) method, the frequency shift keying (FSK) method, the phase shift keying (PSK) method, or the like. The output circuit 106 amplifies radio signals to be used for transmitting the modulated radio signals to the antenna 107.

The reception device 200 includes a receiving unit 201, a signal strength detecting unit 204, an ID extracting unit 207, a history storing unit 208, a strength variance determining unit 209, a determination result output unit 210, and a correcting unit 211.

The receiving unit 201 is equivalent to the receivers shown in FIG. 1, and is formed with a tuning circuit 202 that extracts radio signals in a desired frequency band, and an antenna 203. The receiving unit 201 receives each signal transmitted from the transmission device 100, and adds the area ID of the receiving unit 201 (or the ID representing the areas to which the receivers 2 through 4 of FIG. 1 belong) to the signal. The receiving unit 201 then transmits the signal to the ID extracting unit 207.

The signal strength detecting unit 204 detects the strength of the received signal. The signal strength detecting unit 204 is formed with the rectifier circuit 205 and the voltage (current) measuring circuit 206. The rectifier circuit 205 converts the signal sent from the tuning circuit 202 into a DC voltage or a DC current. The voltage (current) measuring circuit 206 measures the DC voltage or the DC current output from the rectifier circuit 205, so as to measure the signal strength. In this manner, the voltage (current) measuring circuit 206 quantizes the measured DC voltage or DC current in accordance with the circuit mode of the tuning circuit 202, and sets the resultant as the signal strength. The signal strength may be the electric field intensity.

The ID extracting unit 207 extracts ID information from the signal received from the receiving unit 201. Here, the ID information contains the above described tag ID and area ID. The history storing unit 208 is formed with the HDD 14, and stores history data including the ID information extracted by the ID extracting unit 207 and the signal strength detected by the signal strength detecting unit 204.

The strength variance determining unit 209 determines whether the subject person is carrying the transmission device 100, depending on the variance in the signal strength detected by the signal strength detecting unit 204. The determination result output unit 210 outputs the result of the determination by the strength variance determining unit 209. The correcting unit 211 corrects the history data stored in the history storing unit 208.

The ID extracting unit 207, the strength variance determining unit 209, and the correcting unit 211 are embodied by the CPU 11 reading a predetermined program from the HDD 14 into the RAM 13. The determination result output unit 210 is formed with at least one of the following components: the network interface 16, the display 18, the printer interface 19, and the communication unit 20.

Figure 4:
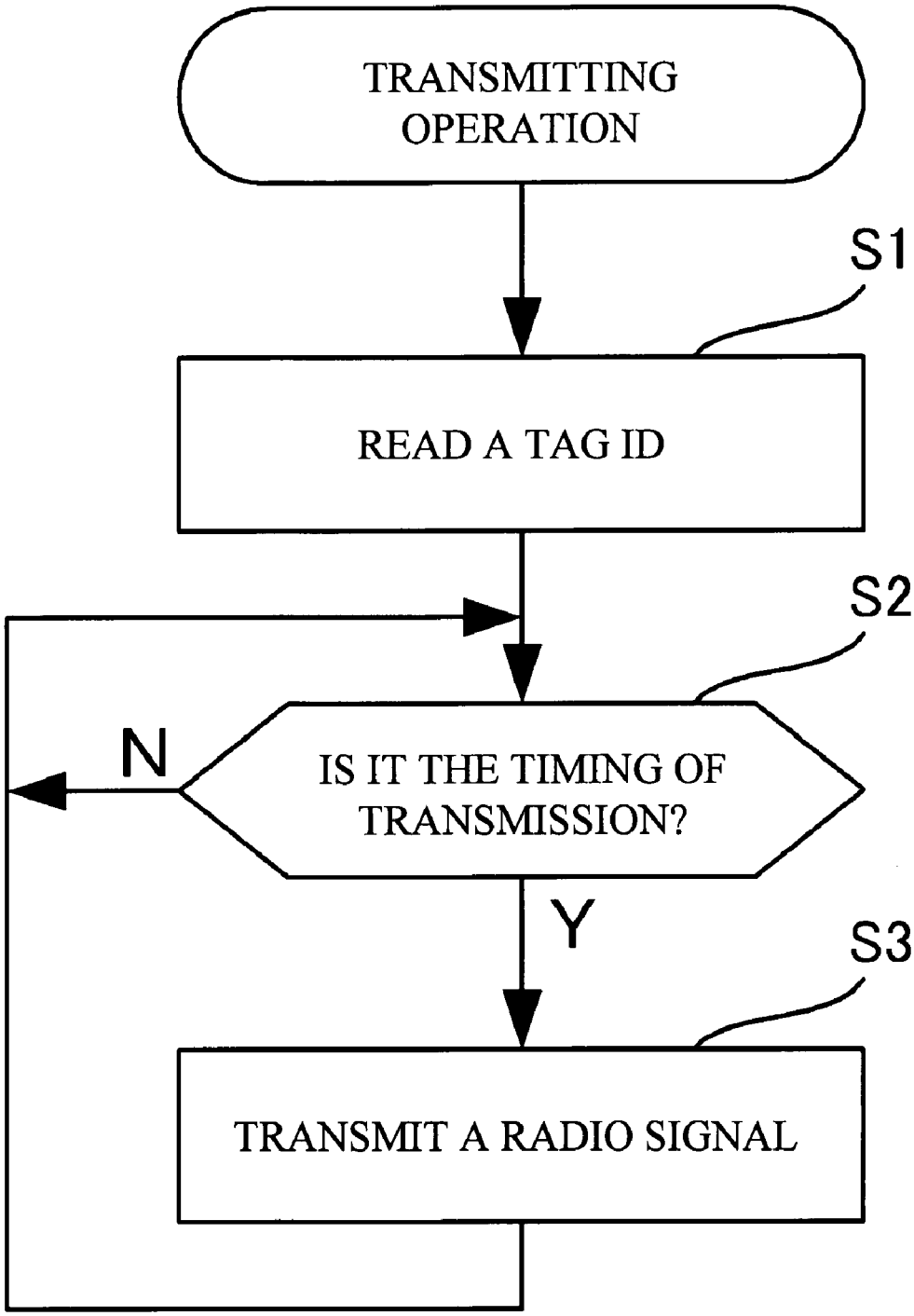
FIG. 4 is a flowchart of the transmitting operation to be performed by the transmission device.

FIG. 4 is a flowchart of the transmitting operation to be performed by the transmission device 100. The transmission device 100 reads the tag ID stored in the ID holding unit 101 (step S1), and determines whether a predetermined transmission timing is reached (step S2). If the predetermined transmission timing is not reached, this determining procedure is repeated. If the predetermined transmission timing is reached, the radio signal modulated with the tag ID read in step S1 is transmitted to the reception device 200 (step S3), and the operation returns to step S2.

Figure 5:
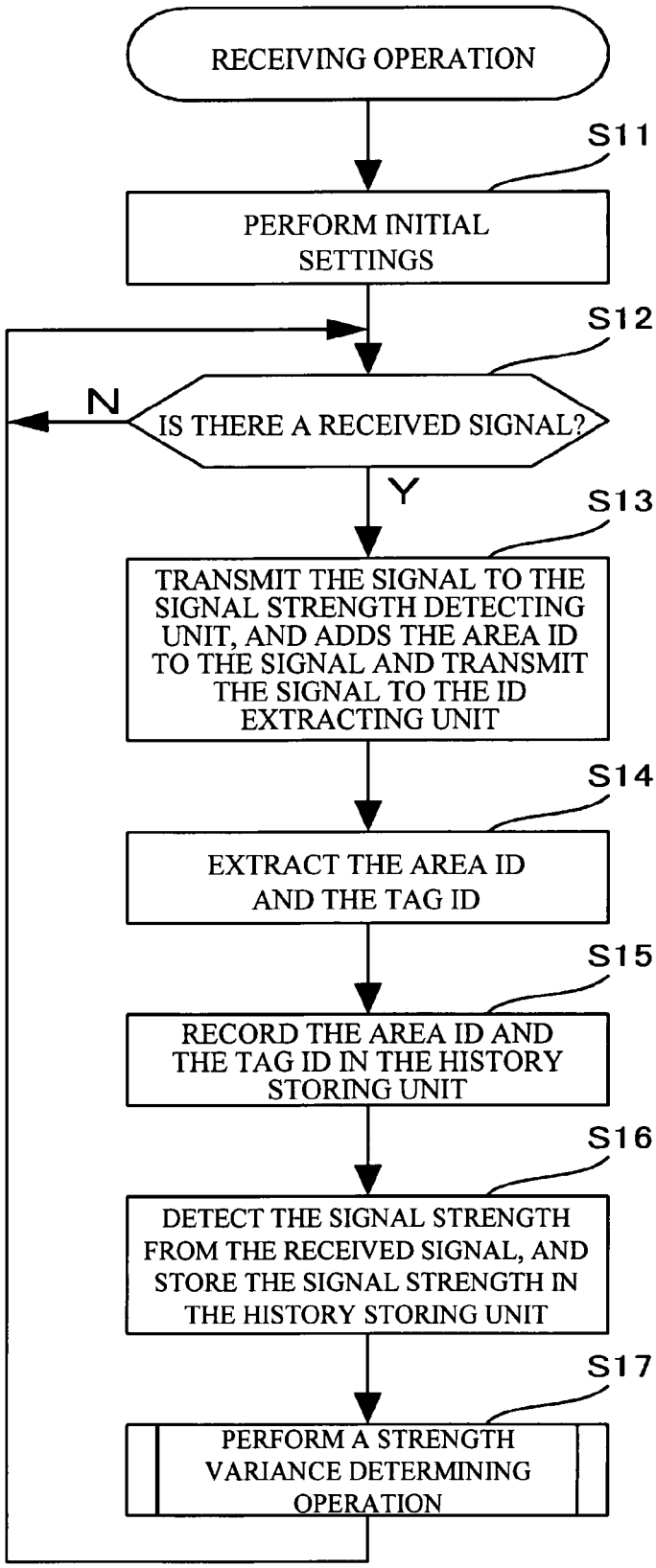
FIG. 5 is a flowchart of the receiving operation to be performed by the reception device.

FIG. 5 is a flowchart of the receiving operation to be performed by the reception device 200. First, when the reception device 200 is switched on, the CPU 11 performs various initial setting operations (step S1). The receiving unit 201 then determines whether there is a signal received from the transmission device 100 (step S12). If there is not a signal received from the transmission device 100, this determining procedure is repeated. If there is a signal received from the transmission device 100, the receiving unit 201 transmits the signal to the signal strength detecting unit 204. The receiving unit 201 also adds the area ID to the signal, and transmits the signal to the ID extracting unit 207 (step S13).

The ID extracting unit 207 extracts the area ID and the tag ID from the signal received from the receiving unit 201 (step S14). The ID extracting unit 207 then stores the area ID and the tag ID in the history storing unit 208 (step S15). The signal strength detecting unit 204 detects the strength of the signal received from the receiving unit 201, and stores the detected signal strength in the history storing unit 208 (step S16). The area ID, the tag ID, and the signal strength that are stored in the history storing unit 208 are associated with the reception time at which the signal is received from the transmission device 100, and are managed as history data.

FIG. 6 shows an example of the history data stored in the history storing unit 208. As shown in FIG. 6, each combination of a reception time, an area ID, a tag ID, and a signal strength value forms one history record. The history data contains more than one history record. With the lapse of time, history records are added to the history data. When a reception time is input and data display is requested through the input unit 15, the history record corresponding to the reception time is read out of the history storing unit 208 and is displayed on the display 18. If printing is requested through the input unit 15 here, the history record is printed out by a printer (not shown).

Figure 7:
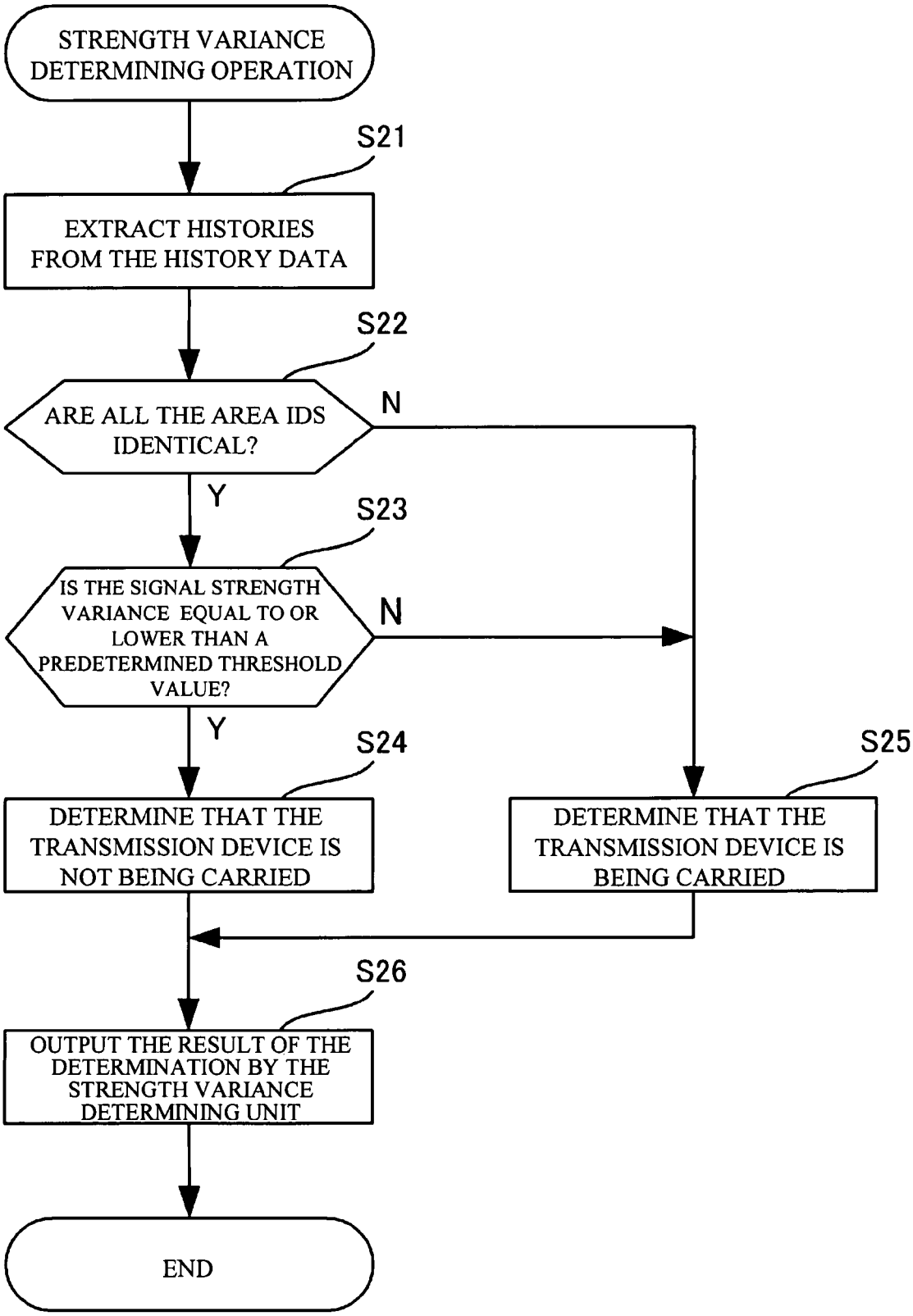
FIG. 7 is a flowchart of the strength variance determining operation to be performed by the strength variance determining unit.

Referring back to FIG. 5, the strength variance determining unit 209 carries out the strength variance determining operation of FIG. 7, based on the history data stored in the history storing unit 208 (step S17). The operation then returns to step S12. The strength variance determining operation of step S17 is not necessarily performed at the same time as the extraction of the area ID and the tag ID and the detection of the signal strength. The strength variance determining operation of step S17 may be performed when an instruction to perform the strength variance determining operation is input through the input unit 15 after the history data is stored in the history storing unit 208.

FIG. 7 is a flowchart of the strength variance determining operation to be performed by the strength variance determining unit 209. This operation is the procedure of step S17 of FIG. 5.

First, the strength variance determining unit 209 extracts history records having successive reception times from the history data for each tag ID (step S21). The strength variance determining unit 209 then determines whether all the area IDs contained in the history records are identical (step S22). If not all the area IDs are identical, the subject person is carrying the active RFID tag while moving, and the strength variance determining unit 109 determines that the active RFID tag is carried (step S25). FIG. 8 shows the history of the tag f. As the area ID changes from "C" to "A" in FIG. 8, the person carrying the tag f has moved from the area C to the area A.

If all the area IDs are determined to be identical in step S22, the strength variance determining unit 209 determines whether the variance in the signal strength shown in the history records is equal to or lower than a predetermined threshold value (step S23). If the signal strength variance is equal to or lower than the threshold value, the strength variance determining unit 209 determines that the subject person is not carrying the active RFID (step S24). If the signal strength variance exceeds the threshold value, the strength variance determining unit 109 determines that the subject person is carrying the active RFID tag (step S25).

The determination result output unit 210 then receives the result of the determination by the strength variance determining unit 209, and outputs the determination result (step S26). This operation then comes to an end. The output of the determination result may be displayed on the display 18 or printed out by a printer.

The determining procedure of step S23 is now described in greater detail.

Figure 10:
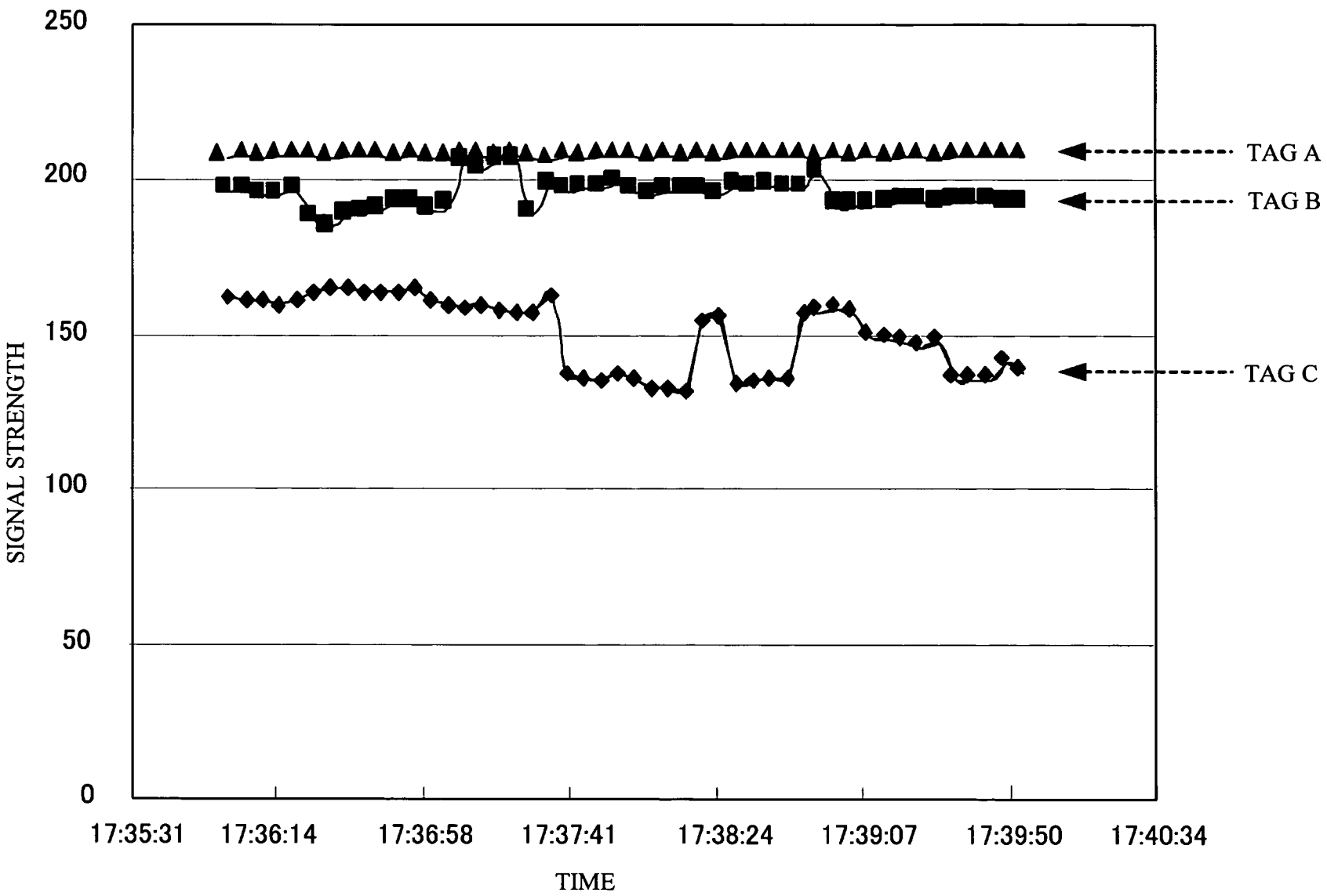
FIG. 10 is a graph plotting the signal strengths and the reception times shown in FIG. 9.

FIG. 9 shows the signal strength of each tag located in the area A. FIG. 10 is a graph plotting the signal strength and the reception times shown in FIG. 9.

The active RFID tag a and the active RFID tag b are carried by the persons H1 and H2, respectively. The body of each person functions as the earth and an antenna (see FIG. 1). In FIGS. 9 and 10, the signal strength varies, as the shapes of the antennas change when the persons H1 and H2 move. Even when the persons H1 and H2 stand still, the signal strength varies due to the pulse and breath.

Meanwhile, the active RFID tag c is left in a handbag (see FIG. 1). Accordingly, changes are not caused by a human body as a conductor, and the value of the signal strength is either "207" or "208". The change in the signal strength is less than 1% with respect to the signal strength value.

The strength variance determining unit 209 calculates the variance in the signal strength of each active RFID tag, based on the signal strength values shown in FIG. 9. As a result, the signal strength variance of the active RFID tag a is 141.9889184, the signal strength variance of the active RFID tag b is 21.61524823, and the signal strength variance of the active RFID tag c is 0.281914894. The strength variance determining unit 209 then sets "2" as the threshold value of the signal strength variance of each active RFID tag for four minutes. The threshold value "2" is an example of the predetermined threshold value in step S23.

The signal strength variance of each of the active RFID tags a and b is greater than the threshold value "2". Accordingly, the strength variance determining unit 209 determines that the active RFID tags a and b are being carried, but the active RFID tag c is not being carried. Based on this determination result, the manager or the person H3 can be notified or alarmed that the active RFID tag c is not being carried. Also, the carrying rate can be calculated as the location measurement precision, and the data as to the tag not being carried can be omitted from the location measurement data.

Second Exemplary Embodiment

In the first exemplary embodiment, the determination result output unit 210 outputs the results of the determinations made by the strength variance determining unit 209 determining whether the transmission device is being carried. In this exemplary embodiment, the result of the determination of whether the transmission device is being carried is stored in the history storing unit 208.

Figure 11:
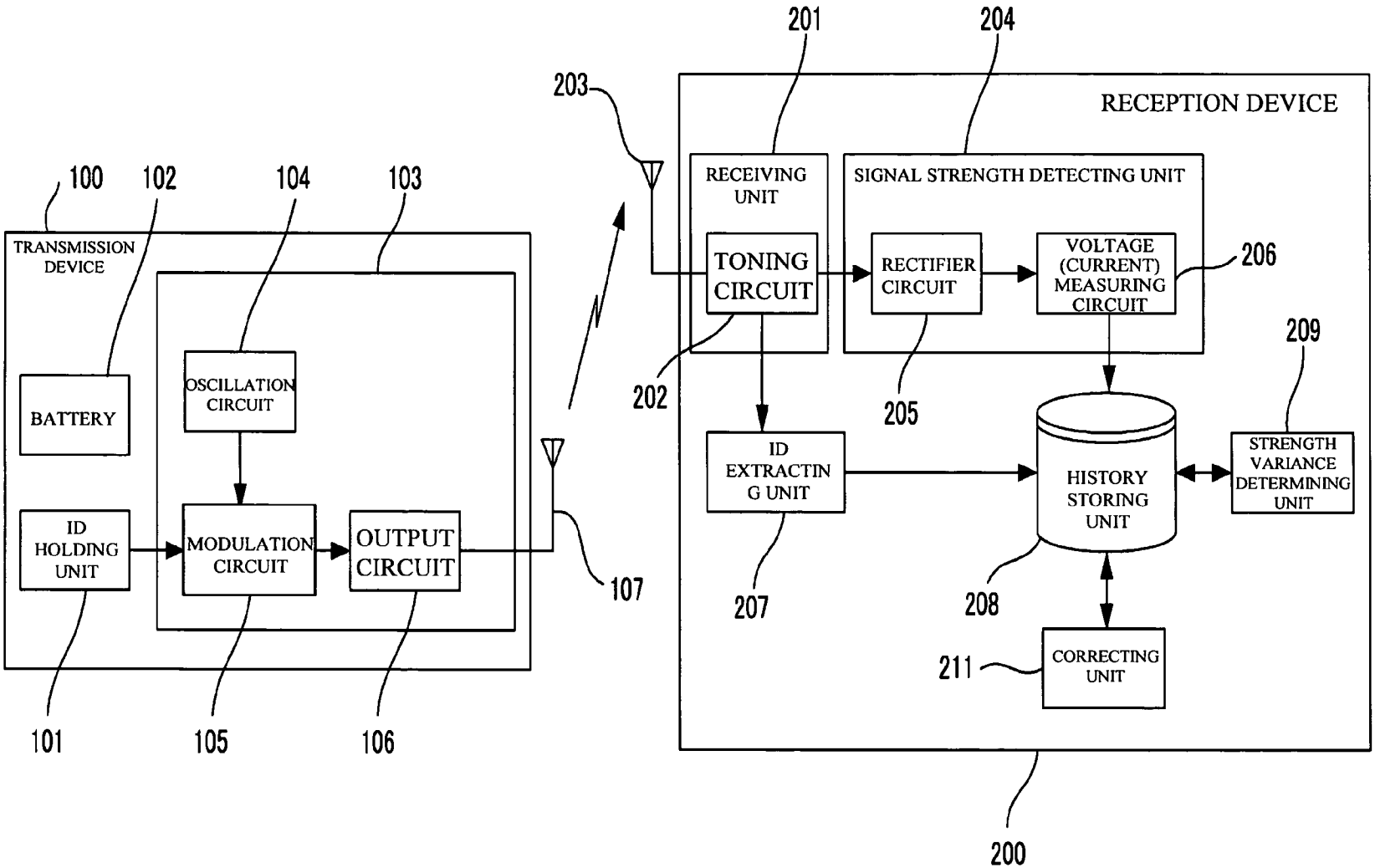
FIG. 11 is a functional block diagram of a transmission device and a reception device in accordance with a second exemplary embodiment of the present invention.

FIG. 11 is a functional block diagram of the transmission device 100 and the reception device 200. The reception device 200 of FIG. 11 is the same as the reception device 200 of FIG. 3, except that the determination result output unit 210 is removed. Also, the strength variance determining unit 209 has the function of storing the result of determination of whether the transmission device is being carried in the history storing unit 208. The other functional blocks of the reception device 200 of FIG. 11 are the same as the functional blocks of the reception device 200 of FIG. 3, and the functional blocks of the transmission device 100 of FIG. 11 are the same as the functional blocks of the transmission device 100 of FIG. 3. Therefore, explanation of them is omitted herein.

FIG. 12 shows an example of the history data that also contains the results of determinations of whether the transmission device is being carried. As shown in FIG. 12, the results of determinations of whether the transmission device is being carried are added to the history data stored in the history storing unit 208 shown in FIG. 6.

Figure 13:
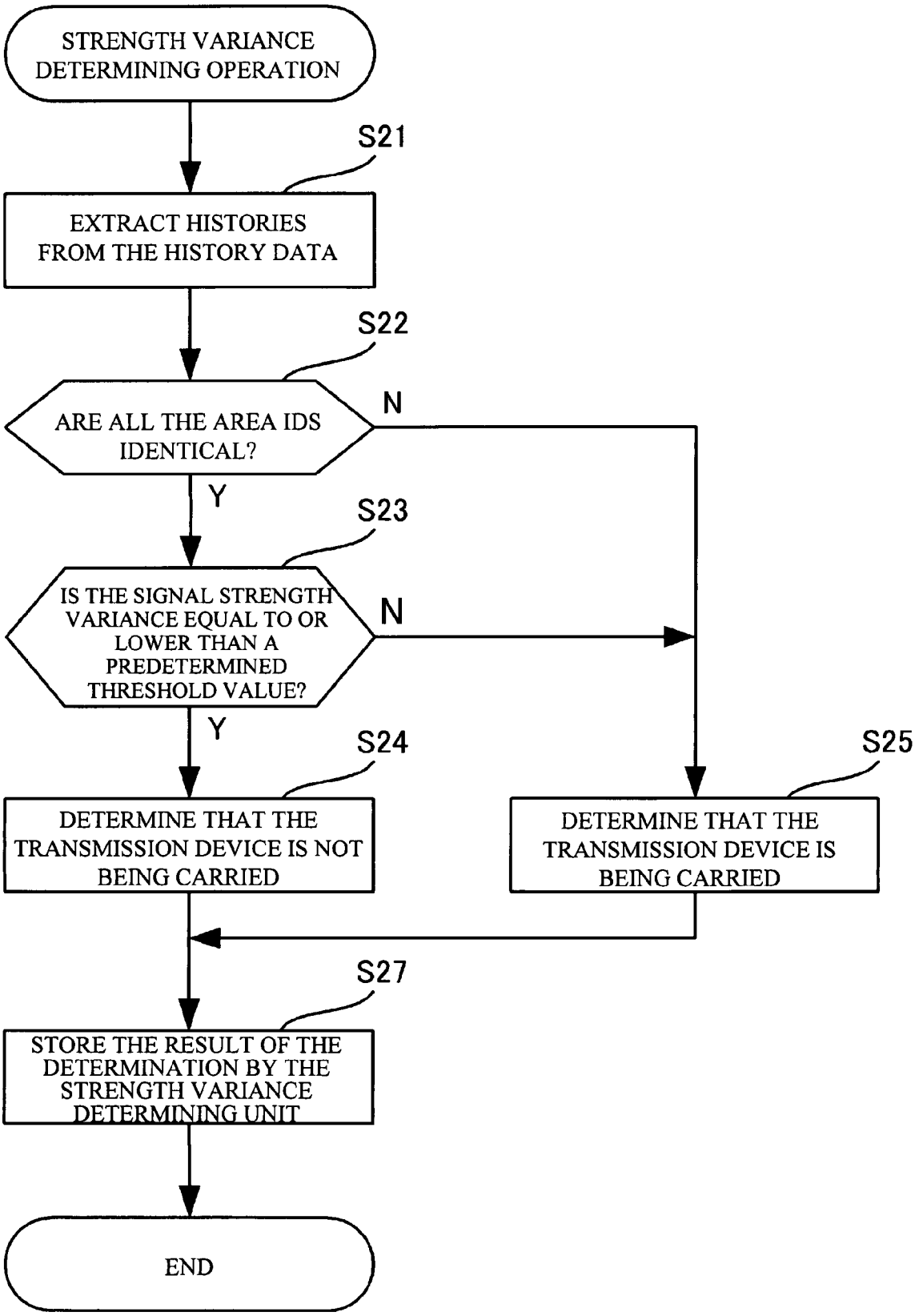
FIG. 13 is a flowchart of the strength variance determining operation to be performed by the strength variance determining unit.

FIG. 13 is a flowchart of the strength variance determining operation to be performed by the strength variance determining unit 209. The strength variance determining operation of this exemplary embodiment differs from the strength variance determining operation of FIG. 7 in that the procedure of step S27 is carried out, instead of the procedure of step S26 of FIG. 7. In step S27, the strength variance determining unit 209 adds the results of determinations of whether the transmission device is being carried to the history data in the history storing unit 208, and then stores the history data in the history storing unit 208. The procedures of steps S21 through S25 are the same as the procedures of steps S21 through S25 of FIG. 7, and therefore, explanation of them is omitted herein.

The strength variance determining operation of FIG. 13 is not necessarily performed at the same time as the extraction of the area ID and the tag ID and the detection of the signal strength. The strength variance determining operation of this exemplary embodiment may be performed when an instruction to perform the strength variance determining operation is input through the input unit 15 after the history data is stored in the history storing unit 208.

As described above, since the results of determinations of whether the transmission device is being carried are added to the history data, the correcting unit 211 may delete the history of each transmission device that is not being carried, or delete the history of each transmission device that is being carried, so as to leave only the necessary information for history data analysis. Particularly, the results showing that the transmission device is not being carried during late night hours (from 0:00 at midnight to 6:00 a.m., for example) may be deleted from the history data, as the users often leave the transmission devices in the areas. In this manner, more accurate history data analysis can be carried out.

Since the results of determinations of whether the transmission device is being carried are added to the history data, a complementary function of calculating the transmission device carrying rate or non-carrying rate can be provided in the history data analysis.

Third Exemplary Embodiment

In the first exemplary embodiment, the determination result output unit 210 outputs the results of determinations made by the strength variance determining unit 209 determining whether the transmission device is being carried. In this exemplary embodiment, on the other hand, the results of determinations of whether the transmission device is being carried and signals containing the tag IDs corresponding to the results are transmitted to a remote terminal.

Figure 14:
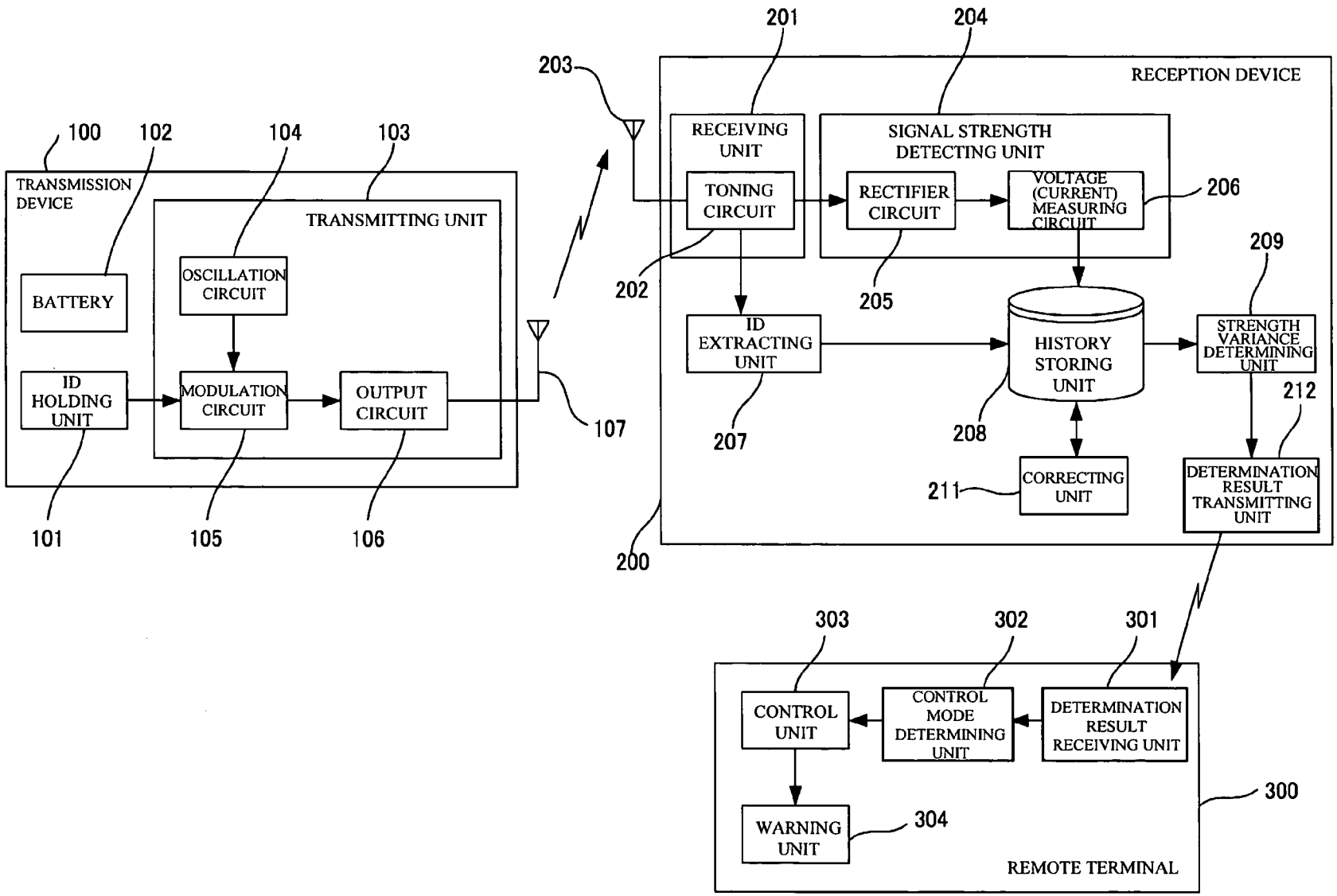
FIG. 14 is a functional block diagram of a transmission device, a reception device, and a remote terminal in accordance with a third exemplary embodiment of the present invention.

FIG. 14 is a functional block diagram of the transmission device 100, the reception device 200, and a remote terminal 300. The reception device 200 of FIG. 14 is the same as the reception device 200 of FIG. 3, except that the determination result output unit 210 is replaced with a determination result transmitting unit 212 that transmits the results of determinations of whether the transmission device is being carried to the remote terminal 300. The other functional blocks of the reception device 200 are the same as the functional blocks of the reception device 200 of FIG. 3, and the functional blocks of the transmission device 100 are the same as the functional blocks of the transmission device 100 of FIG. 3. Therefore, explanation of them is omitted herein.

The remote terminal 300 may be a portable telephone device, for example, and include a determination result receiving unit 301, a control mode determining unit 302, a control unit 303, and a warning unit 304. The determination result receiving unit 301 receives the results of determinations of whether the transmission device is being carried and signals containing the corresponding tag IDs from the determination result transmitting unit 212. The control mode determining unit 302 determines the control mode in which the remote terminal 300 is to be controlled, based on the determination results contained in the received signals. The control unit 303 performs a control operation in the control mode determined for the remote terminal 300. The warning unit 304 issues warnings under the control of the control unit 303. The results of determinations of whether the transmission device is being carried and the signals containing the corresponding tag IDs function as the information notifying that the transmission device should be carried.

Figure 15:
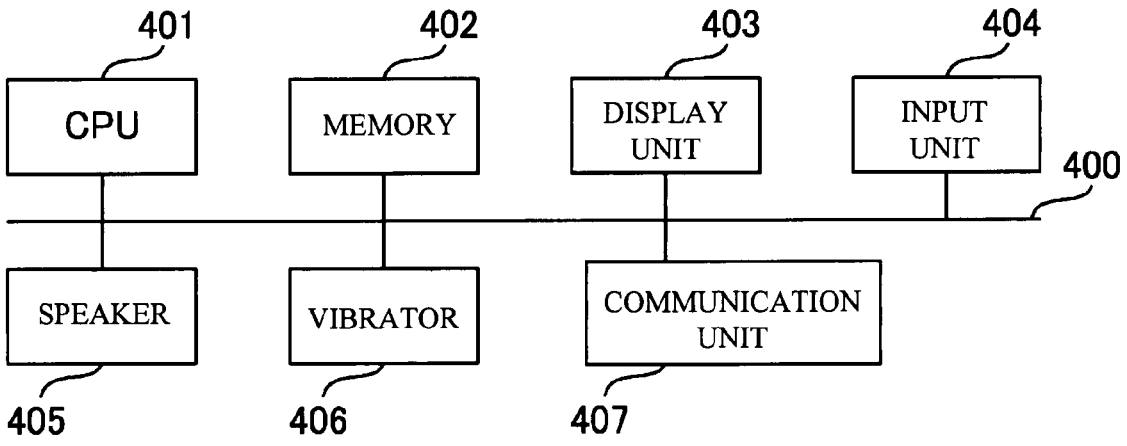
FIG. 15 is a block diagram showing the hardware structure of the remote terminal.

FIG. 15 is a block diagram of the hardware structure of the remote terminal 300. The remote terminal 300 includes a CPU 401 that controls the entire terminal, a memory 402 that stores predetermined programs and information, a display unit 403 formed with a liquid crystal panel or the like, an input unit 404 formed with components such as buttons and cursor keys, a speaker 405 that outputs sounds such as a ring tone and a buzzer tone, a vibrator 406 that vibrates the remote terminal 300 upon receipt of information or the like, and a communication unit 407 that performs wireless communications or communications via a network to exchange information. The CPU 401, the memory 402, the display unit 403, the input unit 404, the speaker 405, the vibrator 406, and the communication unit 407 are connected to one another with a bus 400. The determination result receiving unit 301 is formed with the communication unit 407. The warning unit 304 is formed with the display unit 403, the speaker 405, the vibrator 406, and the likes. The control mode determining unit 302 and the control unit 303 are embodied by the CPU 401 reading a predetermined program or information from the memory 402 and executing the predetermined program.

Figure 16:
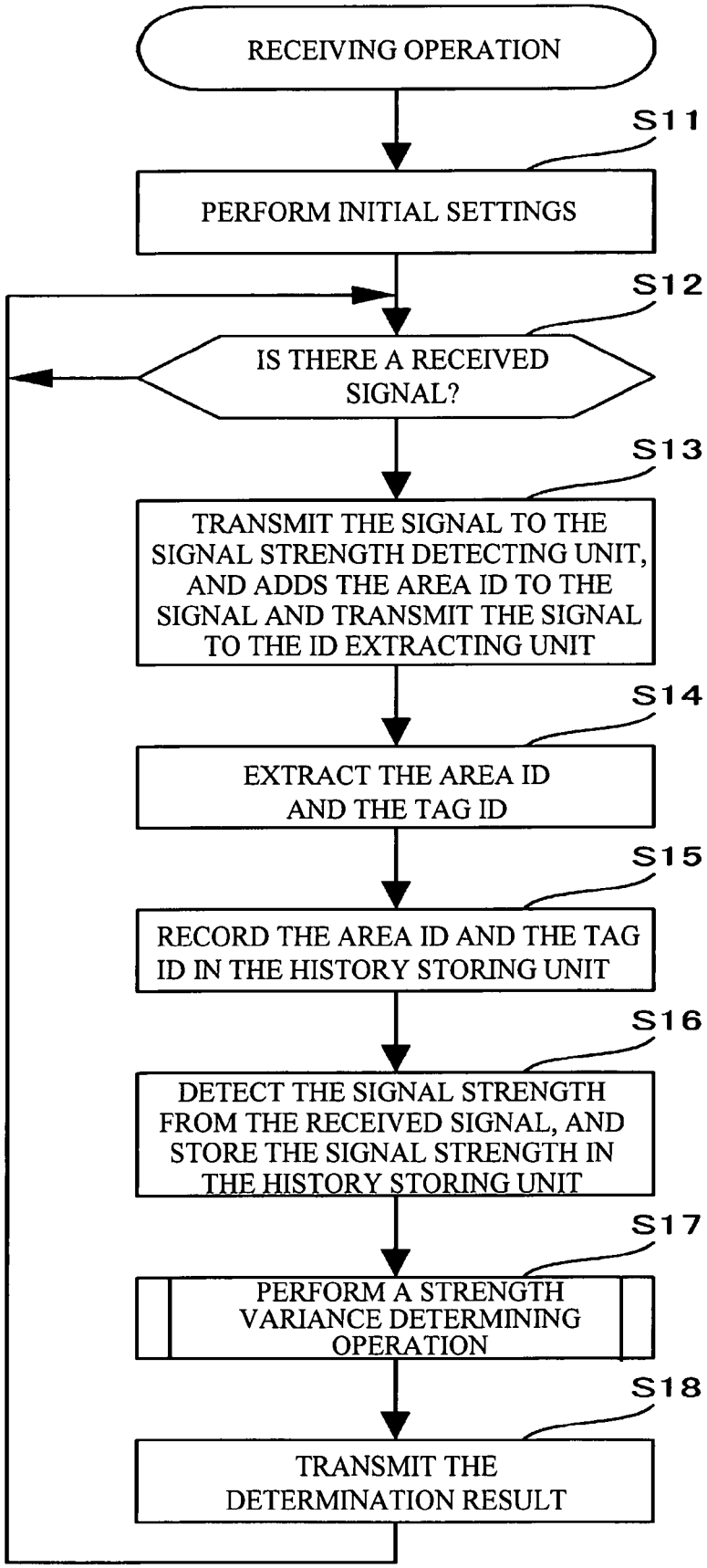
FIG. 16 is a flowchart of the receiving operation to be performed by the reception device.

FIG. 16 is a flowchart of the receiving operation to be performed by the reception device 200. This receiving operation differs from the receiving operation of FIG. 5, in that the procedure of step S18 is added. In step S18, the determination result transmitting unit 212 transmits the determination results obtained in the strength variance determining operation of step S17 to determine whether the transmission device is being carried, and the signals containing the corresponding tag IDs, to the remote terminal 300. The procedures of steps S11 through S17 are the same as the procedures of steps S11 through S17 of FIG. 5, and therefore, explanation of them is omitted herein.

FIG. 17 shows table information to be used for determining the control mode for the remote terminal 300. The table information is stored in the memory 402, and is to be used by the control mode determining unit 302.

The table information defines the results of determinations of whether the transmission device is being carried, the tag IDs corresponding to the determination results, and the control modes for the remote terminal 300. In a case where the determination result for the tag ID "c" is "carried", the vibrator 406 is activated to vibrate the remote terminal 300. In a case where the determination result for the tag ID "c" is "not carried", the speaker 405 sounds a warning tone. In a case where the determination result for the tag ID "a" or "b" is "carried", a control operation is not performed for the remote terminal 300. In a case where the determination result for the tag ID "a" or "b" is "not carried", the speaker 405 sounds a buzzer tone. In this manner, when the transmission device is being carried by a person, an unnecessary ringing tone is not sounded, so as not to make other people uncomfortable.

When the transmission device is not being carried by a person, a ringing tone or a buzzer tone is sounded to prompt the person to carry the transmission device.

The table information shown in FIG. 17 is merely an example. In a case where a determination result is "not carried", the screen on the display unit may be blinked, or a lamp (not shown) may be turned on, for example.

Figure 18:
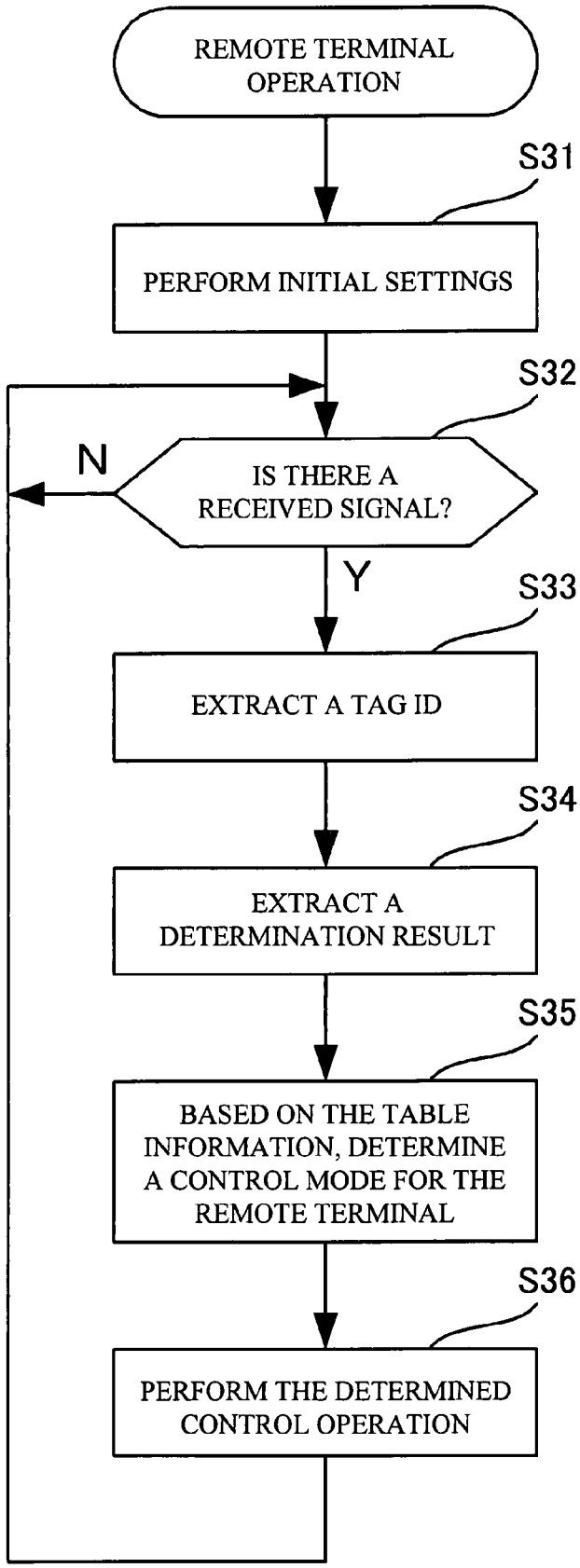
FIG. 18 is a flowchart of the operation to be performed in the remote terminal.

FIG. 18 is a flowchart of an operation to be performed by the remote terminal 300. When power is supplied to the remote terminal 300, the control unit 303 performs various initial setting operations (step S31). The determination result receiving unit 301 determines whether there is a signal transmitted from the reception device 200 (step S32). If there is not a signal transmitted from the reception device 200, this determining procedure is repeated. If there is a signal transmitted from the reception device 200, the control mode determining unit 302 receives the tag ID and the result of a determination of whether the transmission device is being carried through the signal (steps S33 and S34).

Based on the tag ID and the result of the determination of whether the transmission device is being carried, and the table information shown in FIG. 17, the control mode determining unit 302 determines the control mode for the remote terminal 300 (step S35). In the control mode determined in step S35, the control unit 303 controls the warning unit 304 (step S36). The operation then returns to step S32. More specifically, in step S36, the warning unit 304 activates the vibrator 406 or causes the speaker 405 to sound a buzzer tone or a ringing tone in the control mode determined in step S35.

In this exemplary embodiment, the transmission device 100 and the remote terminal 300 are structures independent of each other. However, it is possible to integrally form the transmission device 100 and the remote terminal 300. In such a case, the transmission device 100 includes all the functional blocks of the transmission device 100 and the remote terminal 300 shown in FIG. 14. The integrally formed transmission device 100 and remote terminal 300 may be a portable telephone device or a PHS terminal. The reception device 200 is a computer, but may be some other structure. As long as having all the functional blocks of the reception device 200 shown in FIG. 14, the reception device 200 may be a base station that receives radio signals from portable telephone devices.

Fourth Exemplary Embodiment

In the second exemplary embodiment, the results of determinations of whether the transmission device is being carried are added to the history data to be stored in the history storing unit 208. In this exemplary embodiment, on the other hand, the history data is used for analyzing the attendance rate of the employees of a company or the likes.

Figure 19:
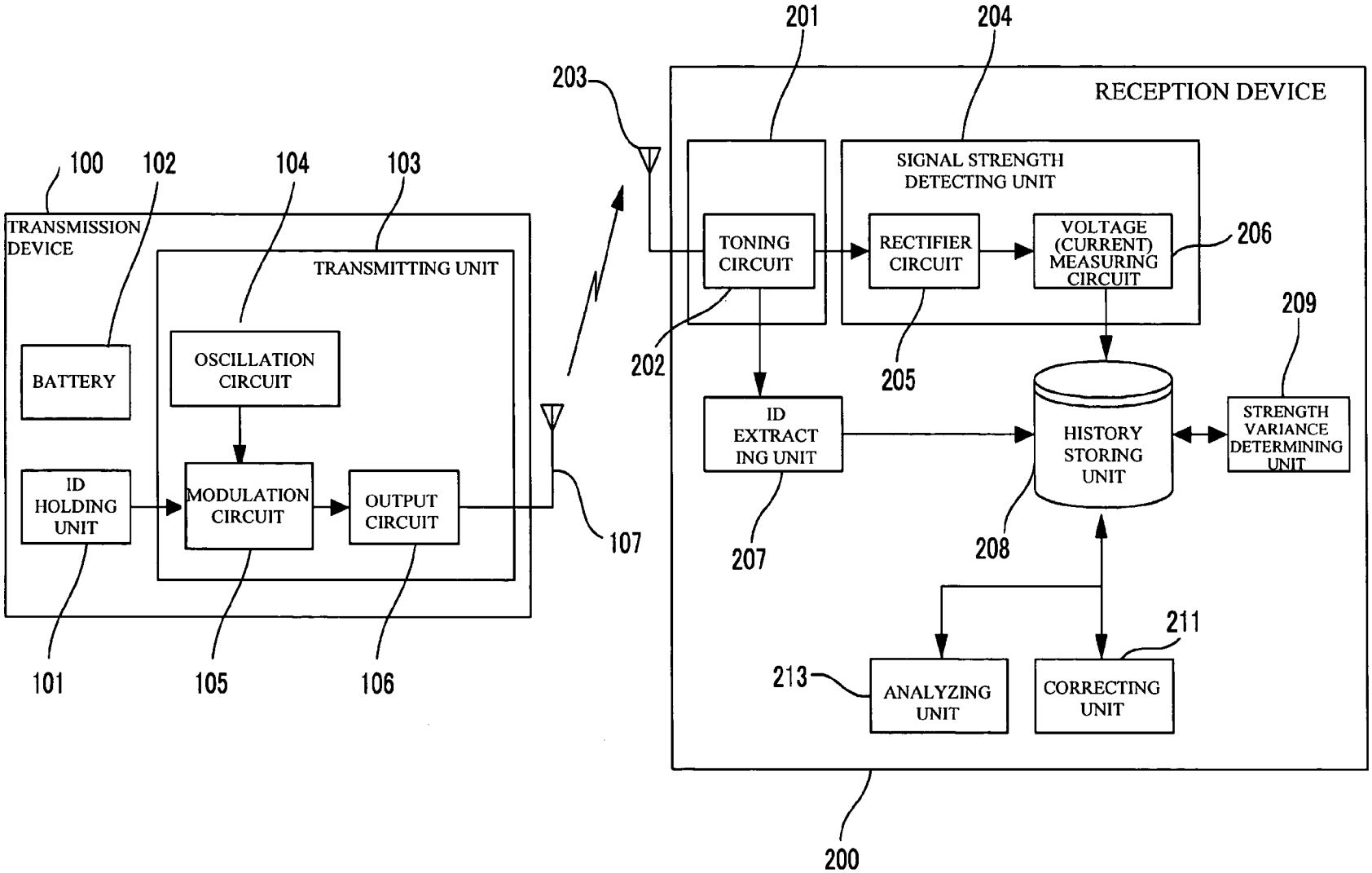
FIG. 19 is a functional block diagram of a transmission device and a reception device in accordance with a fourth exemplary embodiment of the present invention.

FIG. 19 is a functional block diagram of the transmission device 100 and the reception device 200. The reception device 200 of FIG. 19 is the same as the transmission device 200 of FIG. 11, except that an analyzing unit 213 is added to the structure.

The analyzing unit 213 analyzes the history data stored in the history storing unit 208, and obtains the analysis results. The analysis results are stored in the history storing unit 208. The correcting unit 211 and the analyzing unit 213 are embodied by the CPU 11 reading a predetermined program from the HDD 14 into the RAM 13. The other functional blocks of the reception device 200 of this exemplary embodiment are the same as the functional blocks of each reception device 200 of FIGS. 3 and 11. The functional blocks of the transmission device 100 of this exemplary embodiment are the same as the functional blocks of each transmission device 100 of FIGS. 3 and 11. Therefore, explanation of them is omitted herein.

FIG. 20 shows an attendance list of the employees of a company or the likes analyzed by the analyzing unit 213. The reception device 200 operates 24 hours a day, and the history data including the results of determination of whether the transmission device is being carried is updated whenever necessary.

In FIG. 20, the column "Time" indicates the hour. For example, in the row of "6:00:00", the history analysis results obtained from 6:00:00 to 6:59:59 are recorded. The column "Detected (Varied)" shows the numbers of kinds of the tag IDs recorded as "carried" in the column of history data determination results. For example, where the tag IDs recorded as "carried" in the column of history data determination results are the three kinds of "a", "b", and "c", "3" is recorded in the column "Detected (Varied)".

The column "Detected (Unvaried)" shows the numbers of kinds of the tag IDs recorded as "not carried" in the column of history data determination results. In the column "Undetected", the numbers of tag ID kinds of active RFID tags with which the reception device 200 cannot detect radio signals are recorded. In the column "Attendance rate", the values each obtained by dividing the sum of the values in the corresponding cells in the columns "Detected (Varied)" and "Detected (Unvaried)" by the population parameter (389 in this example) are recorded. In the column "Corrected attendance rate", the values each obtained by dividing the value in the corresponding cell of the column "Detected (Varied)" by the value obtained by subtracting the value in the corresponding cell of the "Detected (Unvaried)" from the population parameter (389) are recorded.

Those values in the columns "Detected (Varied)", "Detected (Unvaried)", "Undetected", "Attendance rate", and "Corrected attendance rate" are recorded by the analyzing unit 213. The calculations necessary to record the values in the columns "Attendance rate" and "Corrected attendance rate" are also performed by the analyzing unit 213. The results of analysis by the analyzing unit 213 shown in FIG. 20 are stored in the history storing unit 208.

In FIG. 20, the number of detected active RFID tags in each hour is counted, and the attendance rate is calculated based on the count. However, not all the employees are always carrying their active RFID tags. As a result, the values in the cells of the column "Detected (Unvaried)" in the hours during which the employees should not be in the office may not be "0", as some of the employees inadvertently leave their active RFID tags in the office. Furthermore, some of the employees carry their active RFID tags but leave their active RFID tags in the office on purpose. Therefore, the values cannot be corrected by subtracting the value in each cell of the column "Detected (Unvaried)" in the hours (from 0:00 at midnight till 6:00 a.m., for example) during which the employees are not in the office from the population parameter (389 in this example).

In FIG. 20, the value in each cell of the column "Detected (Unvaried)" is determined to be the number of active RFID tags left in the office, and is subtracted from the population parameter (389 in this example) of the attendance rate. In this manner, highly accurate attendance rates are obtained as statistical values. For example, the attendance rate at 6:00 a.m. at which no one is actually in the office is corrected to be 0%, so as to obtain analysis results with high accuracy.

As described above, in the fourth exemplary embodiment, the analyzing unit 213 analyzes organizational activities, based on the history data stored as the organizational activity history. Based on the values recorded in the columns "Detected (Varied)", "Detected (Unvaried)", and "Undetected", the analyzing unit 213 calculates the operating rates with respect to organizational activities, such as attendance rates.

FIG. 21 is a list showing the signal strengths of the active RFID tags in each division in a conference area. This signal strength list is stored as history data in the history storing unit 208. FIG. 22A is a list showing the communication amount between the divisions in a conference area. FIG. 22B is a list showing the communication amount obtained by correcting the values shown in FIG. 22A.

In this example, during a certain period of time past 11:00, the signal strength detecting unit 204 detects a tag x1 and a tag x2 held by members of a division X, a tag y4 held by a member of a division Y, and a tag z2 held by a member of a division Z at the same time in the same conference area. Around 17:00, the signal strength detecting unit 204 also detects the tag y4 held by a member of the division Y and a tag z1 held by a member of the division Z at the same time in the same conference area.

Based on the history data (the signal strength list in this case) stored in the history storing unit 208, the analyzing unit 213 determines that there was a communication such as a meeting among the division X, the division Y, and the division Z sometime past 11:00, and there was another communication such as a meeting between the division Y and the division Z around 17:00. The analyzing unit 213 can also check the times at which the signal strengths were detected, so as to estimate the duration of time in which each communication such as a meeting was held. Here, the analyzing unit 213 estimates that the former meeting was held for one hour from 11:00 till 12:00, and the latter was held for one and a half hours from 16:00 till 17:30.

Based on the history data, the analyzing unit 213 calculates the communication amount (a one-hour communication being 1 in this example) among the divisions, so as to obtain the results of communication amount calculations. The analyzing unit 213 further adds up the signal strengths of the active RFID tags of each division in all the conference areas, so as to analyze the communication amounts among the divisions.

However, the signal strength of the tag y4 past 11:00 is fixed at 214, and does not vary at all. In other words, the signal strength variance is equal to or less than the predetermined threshold value. Therefore, the strength variance determining unit 209 determines that the tag y4 is not being carried. Accordingly, the analyzing unit 213 corrects the results of communication amount calculations, as shown in FIG. 22B. In FIG. 22B, "1" is subtracted from the communication amount between the division Y to which the member holding the tag y4 belongs and the divisions X and Z shown in FIG. 22A. This is because the member who holds the tag y4 and belongs to the division Y did not participate in the one-hour communication held from 11:00 till 12:00.

As shown in FIG. 21, the radio field strength of the tag y4 varies in the communication such as a meeting held from 16:00 till 17:30. Accordingly, the analyzing unit 213 does not correct the results of communication amount calculations.

Here, time data is simply used as the communication amounts among the divisions. However, to grasp the tendency in communication among the members from various angles, weights may be added to the communication amounts, or the communication amount with respect to each individual, instead of each division, may be counted.

In this exemplary embodiment, the attendance rates of the employees are analyzed based on the history data, and the communication amounts of the divisions in a conference area are analyzed. However, this exemplary embodiment may be applied to other situations. For example, a control unit that controls the in-house power source may read history data from the history storing unit 208 to extract the area ID with which the determination result is "carried". The control unit then activates only the power source of the corresponding area. By doing so, only the facilities in the area in which at least a person is located are energized, and a power-saving effect can be achieved.

In the first through fourth exemplary embodiments, the detecting unit is formed with the receiving unit 201 and the signal strength detecting unit 204, and the determining unit is formed with the strength variance determining unit 209, for example. The receiving unit is formed with the history storing unit 208, the correcting unit is formed with the correcting unit 211, and the analyzing unit is formed with the analyzing unit 213, for example. The notifying unit is formed with the determination result output unit 210 or the determination result transmitting unit 212, for example. The deciding unit is formed with the control mode determining unit 302, and the executing unit is formed with the control unit 303, for example. The first circuit is formed with the toning circuit 202, the second circuit is formed with the rectifier circuit 205, and the third circuit is formed with the voltage (current) measuring circuit 206, for example.

The respective functional blocks of the ID extracting unit 207, the strength variance determining unit 209, the correcting unit 211, and the analyzing unit 213 of the reception device 200 are embodied by the CPU 11 reading a predetermined program from the HDD 14 into the RAM 13 and executing the predetermined program. However, those functional blocks may be embodied by executing a predetermined program that is read from a storage medium and stored in the RAM 13. The history data to be stored in the history storing unit 208 and the results of analysis by the analyzing unit 213 may be stored in a storage medium.

In the first through fourth exemplary embodiments, the reception device 200 is a computer. However, the reception device 200 may be a portable telephone device, a mobile terminal, or a base station, as long as it has the hardware structure shown in FIG. 2. Particularly, in a case where the transmission device 100 is a portable telephone device and the reception device 200 is a base station, the history data and the likes can be managed at the base station.

In the first through fourth exemplary embodiments, the strength variance determining unit 209 determines whether the transmission device is being carried, and can determine when the transmission device is not being carried. Alternatively, the strength variance determining unit 209 may determine whether the transmission device is not being carried, so that it can determine when the transmission device is being carried.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An information processing device comprising:

a detecting unit that detects an electric field intensity of information received from a portable transmission device that transmits information through radio waves;

a determining unit that determines whether the transmission device is being carried, based on a change in the electric field intensity detected by the detecting unit;

a recording unit that records an activity history of a person who holds the transmission device, based on a result of the detection by the detecting unit, wherein the recording unit records a history of organizational activities; and an analyzing unit that analyzes the organizational activities recorded by the recording unit, wherein the analyzing unit calculates an operating rate with respect to the organizational activities, based on a value obtained by subtracting a number of transmission devices not being carried from a total number of transmission devices, and a number of transmission devices being carried.

2. The information processing device according to claim 1, wherein:

the information contains location information; and the information processing device further comprises:

a correcting unit that corrects information as to a period of time in which the transmission device is determined to be not being carried, based on a result of the determination by the determining unit.

3. The information processing device according to claim 2, wherein the correcting unit performs the correction by deleting the information as to the period of time in which the transmission device is determined to be not being carried.

4. The information processing device according to claim 2, wherein the history contains identification information as to the transmission device, the location information, the electric field intensity, and the result of the determination by the determining unit.

5. The information processing device according to claim 2, wherein the determining unit determines whether the transmission device is being carried, also based on a change in the location information.

6. The information processing device according to claim 2, wherein the transmission device is formed with a plurality of transmission devices; and the detecting unit is provided for each of the transmission devices.

7. The information processing device according to claim 1, wherein the analyzing unit calculates the operating rate with respect to the organizational activities, based on the number of transmission devices being carried, the number of transmission devices not being carried, and a number of transmission devices from which the electric field intensity is not detected.

8. The information processing device according to claim 1, wherein the transmission device is a wireless device that includes an active RFID and a portable telephone device.

9. The information processing device according to claim 1, further comprising:

a notifying unit that notifies at least one of the transmission device and a terminal device that the transmission device must be carried, based on a result of the determination by the determining unit, the terminal device belonging to a person who must carry the transmission device.

10. The information processing device according to claim 9, wherein at least one of the transmission device and the terminal device belonging to the person who must carry the transmission device comprises:

a deciding unit that determines a control mode for at least one of the transmission device and the terminal device, based on information sent from the notifying unit to notify that the transmission device must be carried; and an executing unit that controls a warning for at least one of the transmission device and the terminal device, based on the control mode determined by the deciding unit.

11. The information processing device according to claim 1, wherein:

a terminal device belonging to a person who must carry the transmission device includes a vibrating unit that vibrates the terminal device, an output unit that outputs a sound, and a receiving unit that receives the result of the determination by the determining unit; and when the receiving unit receives a determination result indicating that the transmission device is not being carried, the output unit outputs a sound or the vibrating unit vibrates the terminal device.

12. The information processing device according to claim 11, wherein:

the transmission device and the terminal device belonging to the person who must carry the transmission device are integrally formed with the same device;

when the receiving unit receives a determination result indicating that the transmission device is being carried, the vibrating unit vibrates the terminal device; and when the receiving unit receives a determination result indicating that the transmission device is not being carried, the output unit outputs a sound.

13. The information processing device according to claim 1, wherein the detecting unit comprises a first circuit that retrieves a signal in a desired frequency band from the radio waves of the information transmitted from the portable transmission device, a second circuit that converts the signal transmitted from the first circuit into at least one of a DC current or a DC voltage, and a third circuit that quantizes at least one of the DC current and the DC voltage converted by the second circuit, and measures the electric field intensity.

14. An organizational analysis system comprising:

a plurality of portable transmission devices each having a transmitting unit that transmits information through radio waves; and an information processing device that comprises:

a detecting unit that detects an electric field intensity of information received from each of the portable transmission devices;

a determining unit that determines whether each of the transmission devices is being carried, based on a change in the electric field intensity detected by the detecting unit;

a recording unit that records a history of organizational activities of persons who hold the portable transmission devices, the history including a results of determinations by the determining unit, wherein the recording unit records a history of organizational activities; and an analyzing unit that analyzes the organizational activities recorded by the recording unit, wherein the analyzing unit calculates an operating rate with respect to the organizational activities, based on a value obtained by subtracting a number of transmission devices not being carried from a total number of transmission devices, and a number of transmission devices being carried.

15. The organizational analysis system according to claim 14, further comprising a correcting unit that corrects information as to each period of time in which the transmission devices are determined to be not being carried, based on results of the determinations by the determining unit.

16. The organizational analysis system according to claim 14, wherein:

the information processing device further comprises a notifying unit that notifies at least one of the transmission devices and terminal devices that the transmission device must be carried, based on a result of the determinations by the determining unit, the terminal devices belonging to the persons who must carry the transmission device; and at least one of the transmission devices and the terminal devices belonging to the persons who must carry the transmission devices comprise: a deciding unit that determines a control mode for at least one of the transmission devices and the terminal devices, based on information sent from the notifying unit to notify that the transmission device must be carried; and an executing unit that controls a warning for at least one of the transmission devices and the terminal devices in accordance with the control mode determined by the deciding unit.

17. The organizational analysis system according to claim 14, wherein:

each of the portable transmission devices further comprises a power source and a storing unit that stores identification information as to the transmission device; and the transmitting unit that comprises a generating unit that generates a signal forming the radio waves at a predetermined frequency, a modulating unit that modulates the generated signal with the identification information held by the storing unit, and an amplifying unit that amplifies the modulated signal.

18. A computer readable medium storing a program causing a computer to execute a process for information processing, the process comprising:

detecting an electric field intensity of information received from a portable transmission device that transmits information through radio waves;

determining whether the transmission device is being carried, based on a change in the electric field intensity detected;

recording an activity history of a person who holds the transmission device based on the electric field intensity detected, including recording a history of organizational activities; and analyzing the organizational activities recorded, including calculating an operating rate with respect to the organizational activities, based on a value obtained by subtracting a number of transmission devices not being carried from a total number of transmission devices, and a number of transmission devices being carried.

19. An information processing method comprising:

detecting an electric field intensity of information received from a portable transmission device that transmits information through radio waves;

determining whether the transmission device is being carried, based on a change in the electric field intensity detected;

recording an activity history of a person who holds the transmission device based on the electric field intensity detected, including recording a history of organizational activities; and analyzing the organizational activities recorded, including calculating an operating rate with respect to the organizational activities, based on a value obtained by subtracting a number of transmission devices not being carried from a total number of transmission devices, and a number of transmission devices being carried.

* * * * *